US010627058B2

(12) United States Patent
Zeng et al.

(10) Patent No.: US 10,627,058 B2
(45) Date of Patent: Apr. 21, 2020

(54) DOWNLIGHT APPARATUS

(71) Applicant: XIAMEN ECO LIGHTING CO. LTD., Xiamen (CN)

(72) Inventors: Maojin Zeng, Xiamen (CN); Xiaoliang Wen, Xiamen (CN); Xiaojuan Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/019,400

(22) Filed: Jun. 26, 2018

(65) Prior Publication Data

US 2018/0372283 A1 Dec. 27, 2018

(30) Foreign Application Priority Data

Jun. 27, 2017 (CN) ..... 2017 2 0755809 U
Aug. 4, 2017 (CN) ..... 2017 2 0968331 U

(51) Int. Cl.

| | |
|---|---|
| ***F21S 8/02*** | (2006.01) |
| ***F21V 21/30*** | (2006.01) |
| ***F21V 21/04*** | (2006.01) |
| *F21Y 115/10* | (2016.01) |
| *F21V 29/70* | (2015.01) |

(52) U.S. Cl.

CPC ..... *F21S 8/026* (2013.01); *F21V 21/044* (2013.01); *F21V 21/30* (2013.01); *F21V 21/04* (2013.01); *F21V 29/70* (2015.01); *F21Y 2115/10* (2016.08)

(58) Field of Classification Search

CPC ..... F21S 8/026; F21V 21/30; F21V 21/04
See application file for complete search history.

(56) References Cited

U.S. PATENT DOCUMENTS

| | | | | |
|---|---|---|---|---|
| 6,361,193 | B1 * | 3/2002 | Gabrius | F21S 8/02 362/147 |
| 9,010,956 | B1 * | 4/2015 | Davis | F21V 17/06 362/147 |
| 9,892,693 | B1 * | 2/2018 | Kumar | F21S 8/026 |
| 10,062,531 | B1 * | 8/2018 | Peng | H01H 37/04 |
| 2009/0080189 | A1 * | 3/2009 | Wegner | F21S 8/02 362/235 |
| 2013/0051012 | A1 * | 2/2013 | Oehle | F21S 8/026 362/235 |
| 2013/0294084 | A1 * | 11/2013 | Kathawate | F21S 8/026 362/294 |
| 2013/0308319 | A1 * | 11/2013 | Zhang | F21S 8/02 362/311.01 |
| 2015/0198324 | A1 * | 7/2015 | O'Brien | F21V 33/0052 362/294 |

(Continued)

*Primary Examiner* — Donald L Raleigh
(74) *Attorney, Agent, or Firm* — Chun-Ming Shih; Lanway IPR Services

(57) ABSTRACT

A downlight apparatus includes a driver, a LED light source, a back cover and a frame part. The back cover forms a containing space for storing the driver and the LED light source. The back cover has an external side wall fixed with a plurality of lateral sockets. Each lateral socket has an entrance for inserting a corresponding metal piece. The metal piece is fixed to a hook structure when the metal piece is inserted into the lateral socket at a predetermined position from the entrance. The frame part is connected to the back cover. the frame part has an opening for a light of the LED light source emitted from the opening.

18 Claims, 6 Drawing Sheets

(56) References Cited

U.S. PATENT DOCUMENTS

| | | | | |
|---|---|---|---|---|
| 2015/0338077 | A1* | 11/2015 | Johnson | F21V 23/005 362/234 |
| 2016/0281939 | A1* | 9/2016 | Luk | F21S 8/026 |
| 2017/0227195 | A1* | 8/2017 | Feit | F21V 21/04 |
| 2018/0017239 | A1* | 1/2018 | Liu | F21S 8/026 |
| 2018/0051872 | A1* | 2/2018 | Ivey | F21V 33/0056 |
| 2018/0058668 | A1* | 3/2018 | Park | F21V 21/045 |
| 2018/0073687 | A1* | 3/2018 | Musser | F21K 9/275 |
| 2018/0206305 | A1* | 7/2018 | Van Winkle | F21S 8/026 |
| 2018/0306393 | A1* | 10/2018 | Cao | F21S 8/026 |

* cited by examiner

DOWNLIGHT APPARATUS

FIELD OF INVENTION

The present invention is related to a downlight apparatus and more particularly related to a downlight apparatus with an reliable installation structure.

BACKGROUND

There are various lighting apparatuses in the world. Different light apparatuses are designed for satisfying different needs. Among the lighting apparatuses, downlight apparatuses are important and widely seen in offices, houses, and various buildings.

When LED technologies are developing, more and more downlight apparatuses also start migrating into the LED field. For LED devices, they are usually more energy efficient and with larger luminance efficacy. Even LED devices have many advantages over traditional light source elements, LED devices also have some technical problems to be solved. For example, heat dissipation is always a key issue when designing LED lighting apparatuses. In addition, when lighting apparatuses use LED devices, they have smaller size than traditional lighting apparatuses. To better utilize such advantages, new designs may be introduced to provide more convenience, e.g. on installation.

Because downlight apparatuses are so important in human life, any advancement in such crowded field may bring huge advancement on human life and industrial field.

SUMMARY OF INVENTION

According to an embodiment of the present invention, a downlight apparatus includes a driver, a LED light source, a back cover and a frame part.

The back cover forms a containing space for storing the driver and the LED light source. The back cover is a main housing of the downlight apparatus for containing elements of the downlight apparatus. The main housing may be made of one material or multiple materials, like plastic or metal. For most downlight apparatuses, the back cover has a shape and a size to fit in a corresponding installation cavity.

The back cover has an external side wall fixed with a plurality of lateral sockets. Each lateral socket having an entrance for inserting a corresponding metal piece. The metal piece is fixed to a hook structure when the metal piece is inserted from the entrance into the lateral socket at a predetermined position.

The metal pieces have top inverted parts together forming a larger area than an peripheral area of the back cover. The top inverted parts is used for fixing the downlight apparatus to an installation cavity.

The frame part is connected to the back cover. The frame part having an opening for a light of the LED light source emitted from the opening. Usually, the downlight apparatus is a circular device having a circular cover exposed below the ceiling. The circular cover is an example of the frame part mentioned here. The frame part is connected to the back cover and extended with an enlarged portion. Sometimes, there are diffusion layer or lens modules for providing soft light or spot light effects respectively.

In some embodiments, a bottom part of the metal piece has a fixing hole being hooked by an block of the lateral socket inserted into the fixing hole. In other words, the fixing hole of the metal piece provides a hooking structure to be fixed to a corresponding lateral socket. A block or various hook structures may be applied to keep the fixing hole at a predetermined position, thus fixing the metal piece with respect to the lateral socket.

In some embodiments, a bottom part of the metal piece has a bottom inverted part. The bottom inverted part may have a second inverted direction opposite to a first inverted direction of the top inverted part. For example, the top inverted part is a top portion bent to a first direction and the bottom inverted part is a bottom portion bent to a direction opposite to the first direction. The bottom inverted part may be hooked into a slot when the metal piece is inserted into the lateral socket. In other words, the bottom inverted part is used for fixing the metal piece to the lateral socket.

In some embodiments, an edge portion of the top inverted part has a curved structure for increasing friction. The curved structure may contain multiple curve shapes, comb shapes, or other shapes with convex or concave elements to increase friction when the top inverted part is touching the installation cavity.

In some embodiments, an edge portion of the top inverted part is encapsulated with a plastic piece for increasing friction. In other words, the edge of the top inverted part that is touching the installation cavity surface may be added with some plastic element to better keep relative position with the installation cavity.

In some embodiments, the lateral socket is adjacent to a heat sink for transmitting heat generated by the LED light source to the metal piece. In the downlight apparatus, the heat sink may refer to a sidewall, a block with fin, an enclosing element surrounding the LED light source, or other components directly or indirectly contact with the LED light source but has heat from the LED light source. The heat sink is close or contact with the lateral socket. The lateral socket further transmits heat to the metal piece to perform better heat dissipation.

In some embodiments, the lateral socket is adjacent to a heat sink for transmitting heat generated by the driver to the metal piece. As mentioned above, the heat sink may refer to a sidewall, a block with fin, an enclosing element surrounding the driver, or other components directly or indirectly contact with the driver but has heat from the driver. The driver and the LED light source are two major heat source. Therefore, any design that helps carrying away heat from the LED light source and the driver helps increase life span and quality of the downlight apparatus.

In some embodiments, the back cover and the frame part are formed as an unibody piece. In such case, the back cover and the frame part may be made in a single molding procedure. The back cover and the frame part may be made of metal or plastic material.

In some embodiments, the back cover has a driver cover and a light source cover. The driver cover and the light source cover are separable. In such design, the driver is kept a distance from the light source. This design also makes it easier to change a driver module for different purpose. Also, heat dissipation problem may be decreased by keeping two heat sources with a distance.

In some embodiments, the metal piece is elastic so that when the downlight apparatus is inserted into the installation cavity, the area of the top inverted parts is decreasing and the area of the top inverted parts is recovered when the downlight apparatus is installed in the installation cavity. In other words, the expanding area of the multiple top inverted parts may be shrunk when entering an opening of the installation cavity. After the downlight apparatus enters the installation cavity, the metal piece recovers and the expanding area of the multiple top inverted parts is enlarged again, so that to keep the downlight apparatus in the installation cavity.

In some embodiments, the metal piece has a convex bar structure. Such convex bar structure may be formed as one bar or multiple bars. Such bars may help increase rigidity and also help heat dissipation.

In some embodiments, the top inverted part has an extension part extended from a main body of the metal piece and is bent over 100 degrees with respect to the main body of the metal piece. In other words, a metal sheet may be used to form the metal piece mentioned here. A top end of the metal sheet is bent with more than 100 degrees to form the top inverted part.

In some embodiments, the back cover has a different color from the metal piece. Such design helps installation of the downlight apparatus easier, particularly when people usually need to stand on a stair to install a downlight apparatus.

In some embodiments, a bottom part of the lateral socket is fixed to the frame part and a lateral part of the lateral socket is fixed to the back cover. In other words, the lateral socket is connected both to the back cover and the frame part, which may also increase overall rigidity of the downlight apparatus.

In some embodiments, tops of the top inverted part are higher than a top of the back cover. In such design, the metal piece may help protect the main body of the downlight apparatus, and keeps the top of the back cover, which is usually containing the driver with a distance from top boundary of the installation cavity.

In some embodiments, the lateral sockets are arranged evenly around the external side wall of the back cover. In other words, the distance between any two lateral sockets is similar or identical. In some embodiments, there are more than three lateral sockets. Three lateral sockets may better stabilize the downlight apparatus than using only two lateral sockets. Using two lateral sockets, however, is also within the protection scope of this invention.

In some embodiments, the frame part is separable form the back cover. When the frame part is separated from the back cover, the metal piece is pressed to release the downlight apparatus from the installation cavity. In other words, users may remove the separable frame part to expose the metal piece. Then, by pressing the metal piece, the downlight apparatus may be easily detached from the installation cavity, e.g. from a ceiling position. The frame part may be connected to the back cover with screw grooves. Using such structures, users only need to rotate the frame part with respect to the back cover, the frame part may be detached from the back cover.

In some embodiments, the lateral socket has more than one arms fixed to the back cover to increase rigidity of the back cover.

In some embodiments, the lateral socket has multiple cells to increase rigidity of the lateral socket.

DETAILED DESCRIPTION

According to an embodiment of the present invention, a downlight apparatus includes a driver, a LED light source, a back cover and a frame part.

The back cover forms a containing space for storing the driver and the LED light source. The back cover is a main housing of the downlight apparatus for containing elements of the downlight apparatus. The main housing may be made of one material or multiple materials, like plastic or metal. For most downlight apparatuses, the back cover has a shape and a size to fit in a corresponding installation cavity.

The back cover has an external side wall fixed with a plurality of lateral sockets. Each lateral socket having an entrance for inserting a corresponding metal piece. The metal piece is fixed to a hook structure when the metal piece is inserted from the entrance into the lateral socket at a predetermined position.

The metal pieces have top inverted parts together forming a larger area than an peripheral area of the back cover. The top inverted parts is used for fixing the downlight apparatus to an installation cavity.

The frame part is connected to the back cover. The frame part having an opening for a light of the LED light source emitted from the opening. Usually, the downlight apparatus is a circular device having a circular cover exposed below the ceiling. The circular cover is an example of the frame part mentioned here. The frame part is connected to the back cover and extended with an enlarged portion. Sometimes, there are diffusion layer or lens modules for providing soft light or spot light effects respectively.

Figure 1:
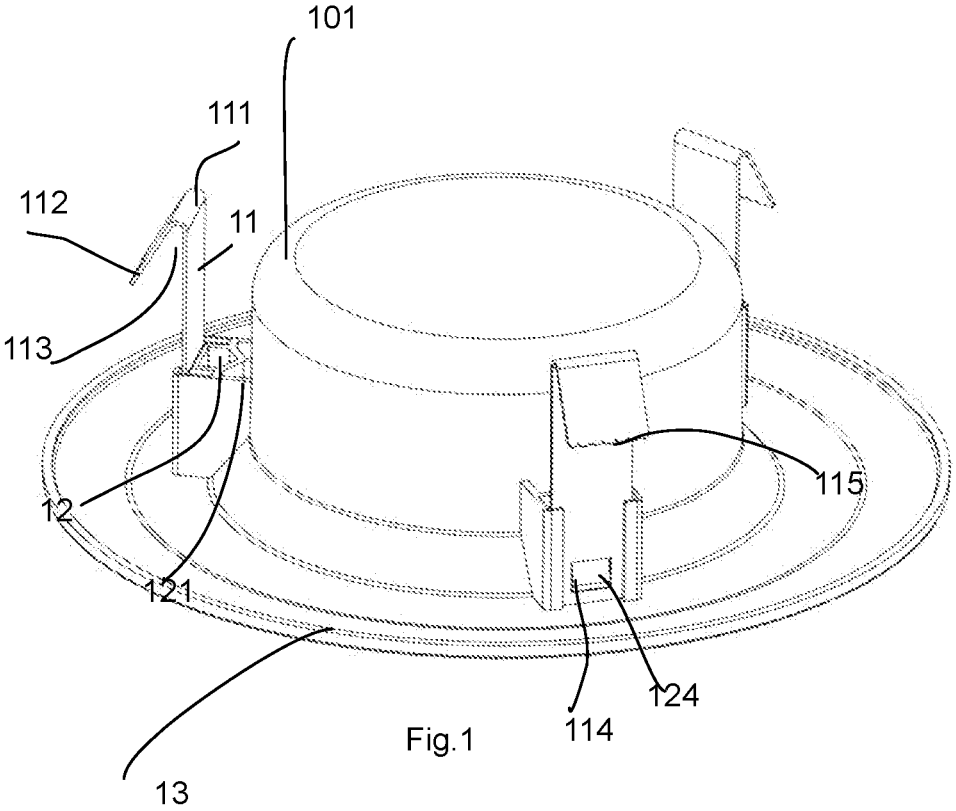
FIG. 1 illustrates an embodiment of a downlight apparatus.
Figure 2:
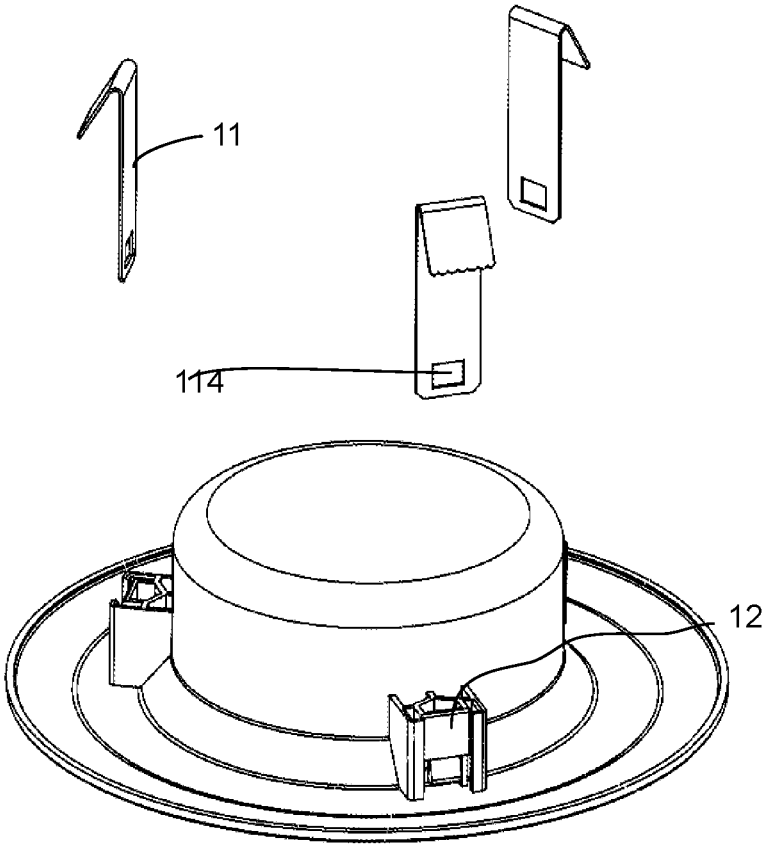
FIG. 2 illustrates a separated diagram of embodiment of FIG. 1.
Figure 3:
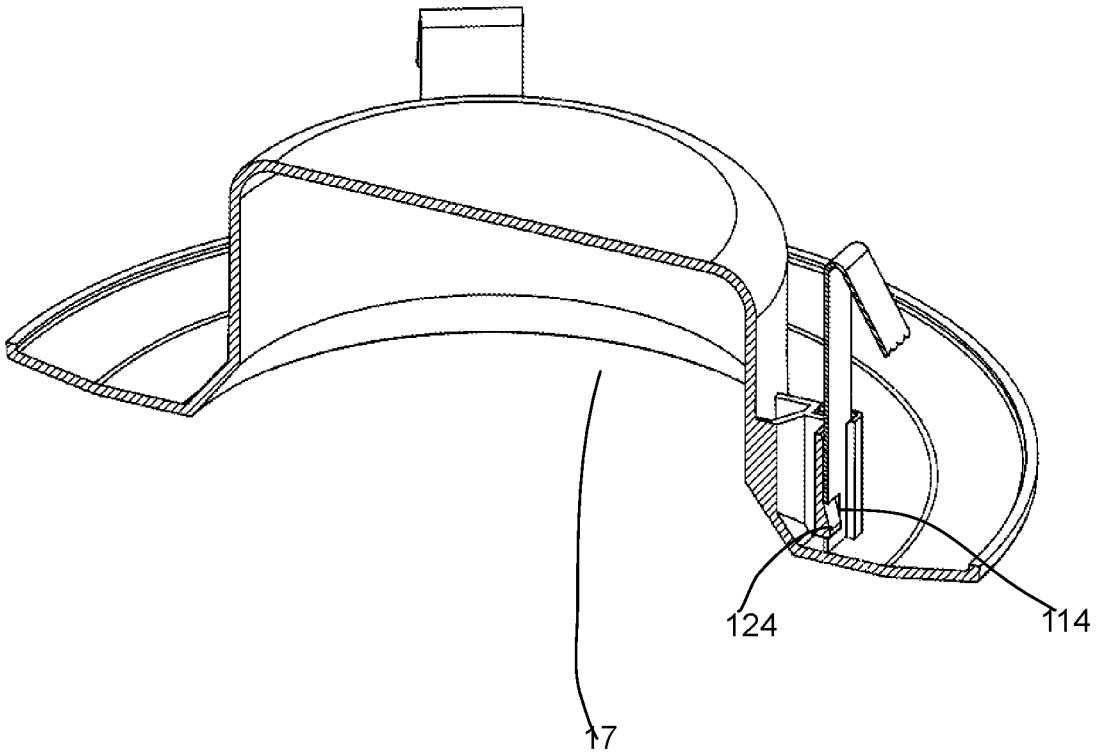
FIG. 3 illustrates a cross-sectional view of the embodiment of FIG. 1.

Please refer to FIG. 1 to FIG. 3, which illustrates an embodiment of a downlight apparatus. In this embodiment, the downlight apparatus has a back cover 101 and a frame part 13. The back cover 101 and the frame part 13 are connected. In some embodiments, these two components may be separated. The back cover 101 defines a containing space 17 for storing a driver, a LED light source and other components.

In addition, there are three lateral sockets 12 fixed to an external side wall of the back cover 101. Each lateral socket 12 has an entrance for inserting a metal piece 11. The metal piece 11 has a top inverted part 112, which may be formed by bending 111 a top portion of a metal sheet. The bending angle with respect to the main body of the metal sheet may be more than 100 degrees so that there is a narrow angle 113 between the top inverted part 113 and the main body of the metal piece 11.

The metal piece also has a fixing hole 114 for being hooked to a corresponding hook structure of the lateral socket, e.g. a block 124. The edge 115 of the top inverted part may have curved structures for increasing friction.

The lateral socket 12 may be fixed to both the back cover 101 and the frame part 13 to increasing rigidity of the downlight apparatus. In addition, there are two arms 121 of the lateral socket 12 to increase the rigidity of the back cover, too. There are several cavity rooms in the lateral socket 12 to decrease material cost, while also increasing rigidity of the lateral socket 12.

In some embodiments, a bottom part of the metal piece has a fixing hole being hooked by a block of the lateral socket inserted into the fixing hole. In other words, the fixing hole of the metal piece provides a hooking structure to be fixed to a corresponding lateral socket. A block or various hook structures may be applied to keep the fixing hole at a predetermined position, thus fixing the metal piece with respect to the lateral socket.

In some embodiments, a bottom part of the metal piece has a bottom inverted part. The bottom inverted part may have a second inverted direction opposite to a first inverted direction of the top inverted part. For example, the top inverted part is a top portion bent to a first direction and the bottom inverted part is a bottom portion bent to a direction opposite to the first direction. The bottom inverted part may be hooked into a slot when the metal piece is inserted into the lateral socket. In other words, the bottom inverted part is used for fixing the metal piece to the lateral socket.

Figure 4:
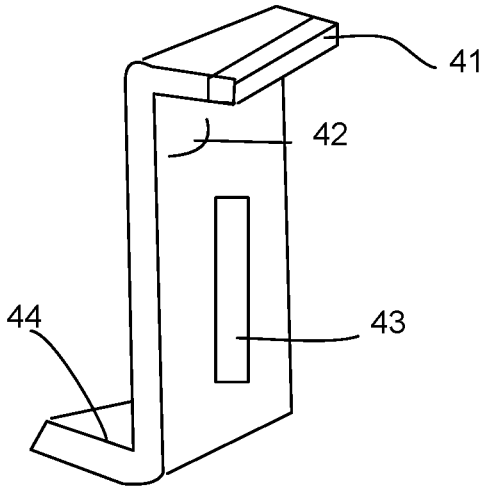
FIG. 4 illustrates another metal piece embodiment.

Please refer to FIG. 4, which illustrates another embodiment of the metal piece. In this example, in addition to a top inverted part, the metal piece also has a bottom inverted part 44 with an opposite inverted direction. Some convex bar 43 may be formed on the metal piece to increase rigidity of the metal piece. A plastic or rubber element 41 may be added on the edge of the top inverted part. The narrow angle 42 between the top inverted part and the main body of the metal piece may be less than 80 degrees.

In some embodiments, an edge portion of the top inverted part has a curved structure for increasing friction. The curved structure may contain multiple curve shapes, comb shapes, or other shapes with convex or concave elements to increase friction when the top inverted part is touching the installation cavity.

In some embodiments, an edge portion of the top inverted part is encapsulated with a plastic piece for increasing friction. In other words, the edge of the top inverted part that is touching the installation cavity surface may be added with some plastic element to better keep relative position with the installation cavity.

Figure 5:
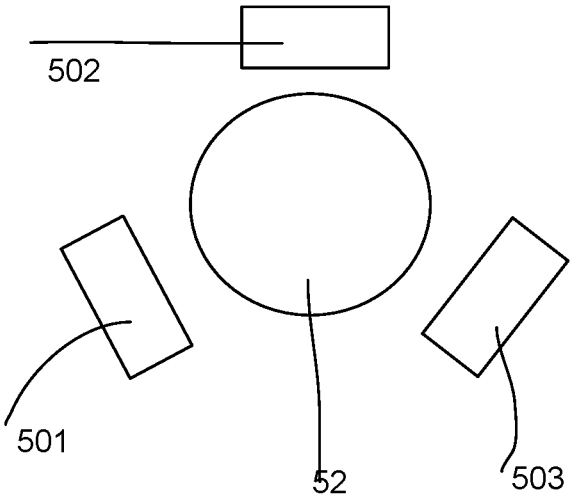
FIG. 5 illustrates spatial relation among metal pieces and the back cover from a top view.

Please refer to FIG. 5, which illustrates component relation from a top view. In this example, top inverted parts of three metal pieces 501, 502, 503 defines a larger area than the back cover 52, and also an entrance opening of an installation cavity. The metal pieces 501, 502, 503 may be pressed to decrease the area of the top inverted parts so as to insert the downlight apparatus into the installation cavity. In addition, tops of the top inverted parts of three metal pieces 501, 502, 503 may be higher than top of the back cover 52.

In some embodiments, the lateral socket is adjacent to a heat sink for transmitting heat generated by the LED light source to the metal piece. In the downlight apparatus, the heat sink may refer to a sidewall, a block with fin, an enclosing element surrounding the LED light source, or other components directly or indirectly contact with the LED light source but has heat from the LED light source. The heat sink is close or contact with the lateral socket. The lateral socket further transmits heat to the metal piece to perform better heat dissipation.

In some embodiments, the lateral socket is adjacent to a heat sink for transmitting heat generated by the driver to the metal piece. As mentioned above, the heat sink may refer to a sidewall, a block with fin, an enclosing element surrounding the driver, or other components directly or indirectly contact with the driver but has heat from the driver. The driver and the LED light source are two major heat source. Therefore, any design that helps carrying away heat from the LED light source and the driver helps increase life span and quality of the downlight apparatus.

Figure 6:
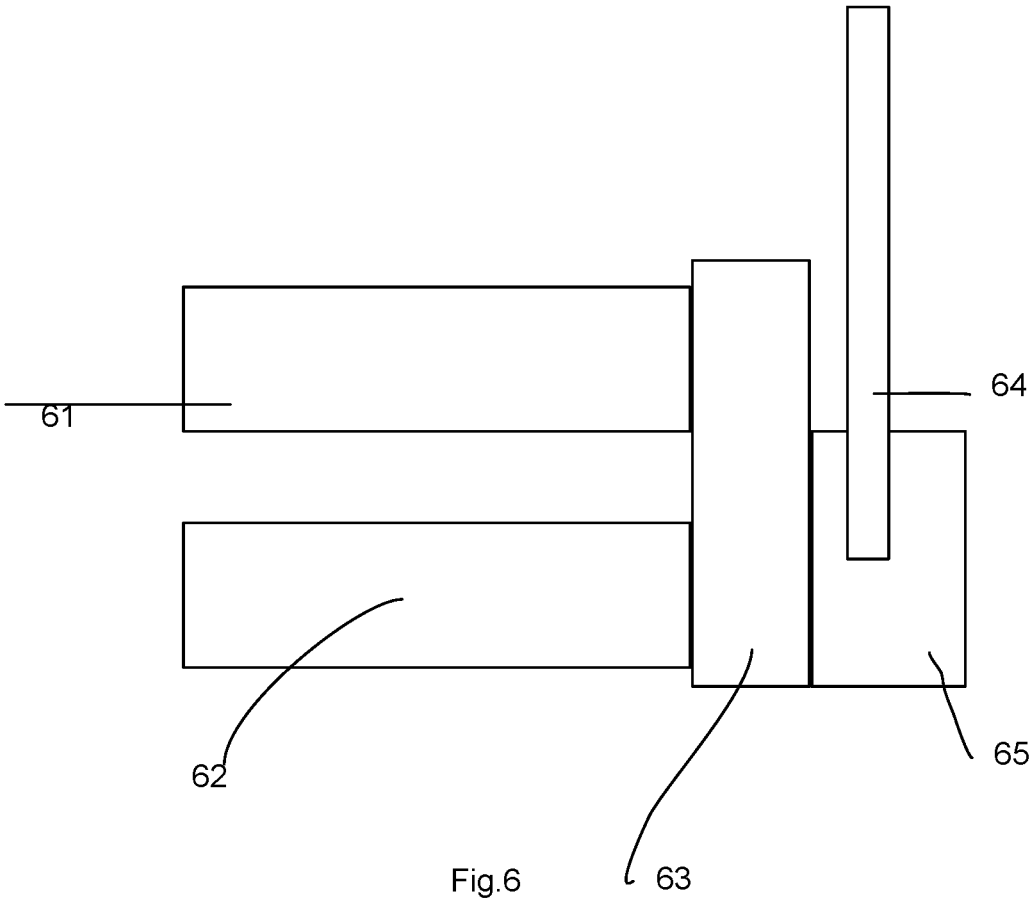
FIG. 6 illustrates component relation to show how heat is transmitted.

Please refer to FIG. 6, which illustrates component relation on how heat is transmitted. In this example, the LED light source 62 and the driver 61 are directly or indirectly connected to a heat sink 63, which may be the cup housing, a specific metal ring or other component to help heat dissipation. The heat is then transmitted to the lateral socket 65, which then further transmits heat to the metal piece 64.

In some embodiments, the back cover and the frame part are formed as an unibody piece. In such case, the back cover and the frame part may be made in a single molding procedure. The back cover and the frame part may be made of metal or plastic material.

In some embodiments, the back cover has a driver cover and a light source cover. The driver cover and the light source cover are separable. In such design, the driver is kept a distance from the light source. This design also makes it easier to change a driver module for different purpose. Also, heat dissipation problem may be decreased by keeping two heat sources with a distance.

In some embodiments, the metal piece is elastic so that when the downlight apparatus is inserted into the installation cavity, the area of the top inverted parts is decreasing and the area of the top inverted parts is recovered when the downlight apparatus is installed in the installation cavity. In other words, the expanding area of the multiple top inverted parts may be shrunk when entering an opening of the installation cavity. After the downlight apparatus enters the installation cavity, the metal piece recovers and the expanding area of the multiple top inverted parts is enlarged again, so that to keep the downlight apparatus in the installation cavity.

In some embodiments, the metal piece has a convex bar structure. Such convex bar structure may be formed as one bar or multiple bars. Such bars may help increase rigidity and also help heat dissipation.

In some embodiments, the top inverted part has an extension part extended from a main body of the metal piece and is bent over 100 degrees with respect to the main body of the metal piece. In other words, a metal sheet may be used to form the metal piece mentioned here. A top end of the metal sheet is bent with more than 100 degrees to form the top inverted part.

In some embodiments, the back cover has a different color from the metal piece. Such design helps installation of the downlight apparatus easier, particularly when people usually need to stand on a stair to install a downlight apparatus.

In some embodiments, a bottom part of the lateral socket is fixed to the frame part and a lateral part of the lateral socket is fixed to the back cover. In other words, the lateral socket is connected both to the back cover and the frame part, which may also increase overall rigidity of the downlight apparatus.

In some embodiments, tops of the top inverted part are higher than a top of the back cover. In such design, the metal piece may help protect the main body of the downlight apparatus, and keeps the top of the back cover, which is usually containing the driver with a distance from top boundary of the installation cavity.

In some embodiments, the lateral sockets are arranged evenly around the external side wall of the back cover. In other words, the distance between any two lateral sockets is similar or identical. In some embodiments, there are more than three lateral sockets. Three lateral sockets may better stabilize the downlight apparatus than using only two lateral sockets. Using two lateral sockets, however, is also within the protection scope of this invention.

In some embodiments, the frame part is separable form the back cover. When the frame part is separated from the back cover, the metal piece is pressed to release the downlight apparatus from the installation cavity. In other words, users may remove the separable frame part to expose the metal piece. Then, by pressing the metal piece, the downlight apparatus may be easily detached from the installation cavity, e.g. from a ceiling position. The frame part may be connected to the back cover with screw grooves. Using such structures, users only need to rotate the frame part with respect to the back cover, the frame part may be detached from the back cover.

In some embodiments, the lateral socket has more than one arms fixed to the back cover to increase rigidity of the back cover.

In some embodiments, the lateral socket has multiple cells to increase rigidity of the lateral socket.

In addition to the above-described embodiments, various modifications may be made, and as long as it is within the spirit of the same invention, the various designs that can be made by those skilled in the art are belong to the scope of the present invention.

The invention claimed is:

1. A downlight apparatus comprising:

a driver;

a LED light source;

a back cover, forming a containing space for storing the driver and the LED light source, the back cover having an external side wall fixed with a plurality of lateral sockets, each lateral socket having an entrance for inserting a corresponding metal piece into a track with a direction substantially parallel to the external side wall, the metal piece being fixed to a hook structure of the lateral socket when the metal piece is inserted into the lateral socket at a predetermined position from the entrance, all the metal pieces having top inverted parts together forming a larger area than an peripheral area of the back cover, the top inverted parts being used for fixing the downlight apparatus to an installation cavity; and a frame part connected to the back cover, the frame part having an opening for a light of the LED light source emitted from the opening.

2. The downlight apparatus of claim 1, wherein a bottom part of the metal piece has a fixing hole being hooked by an block of the lateral socket inserted into the fixing hole.

3. The downlight apparatus of claim 1, wherein a bottom part of the metal piece has a bottom inverted part, the bottom inverted part has a second inverted direction opposite to a first inverted direction of the top inverted part.

4. The downlight apparatus of claim 1, wherein an edge portion of the top inverted part has a curved structure for increasing friction.

5. The downlight apparatus of claim 1, wherein the lateral socket has more than one arms fixed to the back cover to increase rigidity of the back cover.

6. The downlight apparatus of claim 1, wherein the lateral socket is adjacent to a heat sink for transmitting heat generated by the LED light source to the metal piece.

7. The downlight apparatus of claim 1, wherein the lateral socket is adjacent to a heat sink for transmitting heat generated by the driver to the metal piece.

8. The downlight apparatus of claim 1, wherein the back cover and the frame part are formed as an unibody piece.

9. The downlight apparatus of claim 1, wherein the back cover has a driver cover and a light source cover, the driver cover and the light source cover are separable.

10. The downlight apparatus of claim 1, wherein the metal piece is elastic so that when the downlight apparatus is inserted into the installation cavity, the area of the top inverted parts is decreasing and the area of the top inverted parts is recovered when the downlight apparatus is installed in the installation cavity.

11. The downlight apparatus of claim 1, wherein the metal piece has a convex bar structure.

12. The downlight apparatus of claim 1, wherein the top inverted part has an extension part extended from a main body of the metal piece and is bent over 100 degrees with respect to the main body of the metal piece.

13. The downlight apparatus of claim 1, wherein the back cover has a different color from the metal piece.

14. The downlight apparatus of claim 1, wherein a bottom part of the lateral socket is fixed to the frame part and a lateral part of the lateral socket is fixed to the back cover.

15. The downlight apparatus of claim 1, wherein tops of the top inverted part are higher than a top of the back cover.

16. The downlight apparatus of claim 1, wherein the lateral sockets are arranged evenly around the external side wall of the back cover.

17. The downlight apparatus of claim 16, wherein there are more than two lateral sockets.

18. The downlight apparatus of claim 1, wherein the frame part is separable form the back cover, when the frame part is separated from the back cover, the metal piece is pressed to release the downlight apparatus from the installation cavity.

* * * * *